US010634088B2

(12) United States Patent
Ruffing et al.

(10) Patent No.: US 10,634,088 B2
(45) Date of Patent: Apr. 28, 2020

(54) COOLANT JACKET FOR A LIQUID-COOLED CYLINDER HEAD

(71) Applicant: Bayerische Motoren Werke Aktiengesellschaft, Munich (DE)

(72) Inventors: Wolfgang Ruffing, Unterschleissheim (DE); Frank Ruetten, Munich (DE); Ulrich Gutzer, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 13/826,819

(22) Filed: Mar. 14, 2013

(65) Prior Publication Data

US 2013/0192546 A1 Aug. 1, 2013

Related U.S. Application Data

(63) Continuation of application No. PCT/EP2011/004450, filed on Sep. 2, 2011.

(30) Foreign Application Priority Data

Sep. 21, 2010 (DE) ..... 10 2010 041 105

(51) Int. Cl.
*F02F 1/40* (2006.01)
*F01P 3/02* (2006.01)

(52) U.S. Cl.
CPC . *F02F 1/40* (2013.01); *F01P 3/02* (2013.01)

(58) Field of Classification Search
CPC ..... F02F 2001/247; F02F 1/40; F02F 1/4214; F02F 1/242; F02F 1/36; F02B 3/06; F01P 3/02; F01P 2003/024
(Continued)

(56) References Cited

U.S. PATENT DOCUMENTS 3,491,731 A * 1/1970 Deutschmann ..... F01P 3/14 123/41.31
4,993,227 A 2/1991 Nagura et al.
(Continued)

FOREIGN PATENT DOCUMENTS

DE 100 48 582 A1 4/2002
DE 100 60 682 A1 6/2002
(Continued)

OTHER PUBLICATIONS

International Search Report dated Jan. 3, 2012 with English translation (six (6) pages).
(Continued)

*Primary Examiner* — Stephen K Cronin
*Assistant Examiner* — Omar Morales
(74) *Attorney, Agent, or Firm* — Crowell & Moring LLP

(57) ABSTRACT

A coolant jacket is provided for a liquid-cooled cylinder head for an internal combustion engine having a crankcase. The cylinder head has a gas exchange intake side having two gas exchange intake valves and a gas exchange exhaust side having two gas exchange exhaust valves. A fuel injection valve is provided on the intake side and an ignition device is provided on the exhaust side between the gas exchange valves. The coolant jacket extends as a first partial coolant jacket on the exhaust side, coming from the crankcase, between the gas exchange exhaust valves and then radially outside around the ignition device and the fuel injection valve and further in the direction of the intake side and the crankcase. Optimal cooling of the ignition device and the fuel injection valve is achieved which enables high specific powers and pressures leading to fuel consumption and cost advantages.

15 Claims, 2 Drawing Sheets

(58) Field of Classification Search
USPC ..... 123/41.76, 41.72, 41.29
See application file for complete search history.

(56) References Cited

U.S. PATENT DOCUMENTS

| | | | | |
|---|---|---|---|---|
| 6,286,467 | B1 * | 9/2001 | Ancheta | F02B 69/06 123/21 |
| 6,883,472 | B2 | 4/2005 | Krotky et al. | |
| 2010/0089343 | A1 * | 4/2010 | Hamada | F01P 3/02 123/41.74 |

FOREIGN PATENT DOCUMENTS

| | | | | |
|---|---|---|---|---|
| DE | 10060682 | A1 * | 6/2002 | F02B 23/101 |
| DE | 102 37 664 | A1 | 2/2004 | |
| DE | 102 51 360 | B4 | 1/2005 | |
| DE | 10 2006 026 131 | A1 | 12/2007 | |
| DE | 10 2006 036 422 | A1 | 2/2008 | |
| DE | 10 2007 031 350 | A1 | 2/2009 | |
| DE | 10 2007 062 347 | A1 | 6/2009 | |
| DE | 10 2008 047 185 | A1 | 4/2010 | |
| DE | 102008047185 | A1 * | 4/2010 | F02F 1/40 |
| EP | 1 884 647 | A2 | 2/2008 | |
| WO | WO 2004001214 | A1 * | 12/2003 | F01P 3/02 |

OTHER PUBLICATIONS

German Search Report dated Mar. 22, 2011 with English translation (nine (9) pages).

* cited by examiner

COOLANT JACKET FOR A LIQUID-COOLED CYLINDER HEAD

CROSS REFERENCE TO RELATED APPLICATIONS

This application is a continuation of PCT International Application No. PCT/EP2011/004450, filed Sep. 2, 2011, which claims priority under 35 U.S.C. § 119 from German Patent Application No. DE 10 2010 041 105.1, filed Sep. 21, 2010, the entire disclosures of which are herein expressly incorporated by reference.

BACKGROUND AND SUMMARY OF THE INVENTION

The invention relates to a coolant jacket for a liquid-cooled cylinder head for an internal combustion engine with a crankcase, wherein the cylinder head has a gas exchange intake side with two gas exchange intake valves and a gas exchange outlet side with two gas exchange outlet valves.

A coolant jacket for a cylinder head that is cooled with liquid is known from prior art document DE 102 51 360 B4, on which the present invention is based. DE 102 51 360 B4 describes a liquid-cooled cylinder head that is configured for an internal combustion engine that has multiple cylinders. The cylinder head has a coolant flow that flows from a coolant intake on an outlet side to a coolant outlet on an intake side. Furthermore, the cylinder head has a coolant chamber, which is defined by outer walls, a cylinder head bottom and a water chamber roof. The cylinder head has a rib, which hangs from the water chamber roof and, in so doing, projects, as a flow guiding element, more or less transversely to the coolant flow. Furthermore, at least one intake valve and two outlet valves with gas exchange channels are arranged in each cylinder section. Furthermore, a coolant intake is provided from the bottom in a coolant distributor channel. Starting from this coolant distributor channel, a side coolant channel passes between the gas exchange channel of an outlet valve and a screw hole of a cylinder head screw. A central coolant channel passes between the two gas exchange channels of the outlet valves. The liquid-cooled cylinder head that is described in DE 102 51 360 B4 is characterized in that the central coolant channel guides the coolant flow to the rib in the water chamber root and this rib is connected to the spark plug hole on the water chamber roof and has a flow-guiding manifold in a region of an impingement point of the coolant flow from the central coolant channel.

This type of coolant jacket, known from the prior art, does not optimally cool the cylinder head, in particular, in the region of the highest volume of heat input between the gas exchange outlet valves and the ignition device.

The object of the present invention is to provide a coolant jacket that is configured for a liquid-cooled cylinder head and that does not exhibit the aforementioned drawback.

This and other objects are achieved by providing a coolant jacket for a liquid-cooled cylinder head for an internal combustion engine with a crankcase, wherein the cylinder head has a gas exchange intake side with two gas exchange intake valves and a gas exchange outlet side with two gas exchange outlet valves. A fuel injection valve is provided on the intake side and an ignition device is provided on the outlet side between the gas exchange valves. The coolant jacket extends as a first partial coolant jacket on the outlet side, coming from the crankcase, between the gas exchange outlet valves, and then radially outside around the ignition device and the fuel injection valve and further in the direction of the intake side and the crankcase.

According to the invention, the coolant jacket is designed in such a way that the coolant flows from the outlet side from the crankcase, coming centrally relative to the cylinder into the cylinder head (optionally, also laterally next to the gas exchange outlet channels) and there in close proximity to the combustion chamber roof between the gas exchange outlet valves and around the ignition device and the fuel injection device in the direction of the intake side. In particular, the coolant jacket envelops to a large extent the threaded region of the ignition device.

In an advantageous embodiment, the cylinder head includes a gas exchange outlet channel on the gas exchange outlet side, wherein a second and a third partial coolant jacket are provided. The second and third partial cooling jackets, arranged on both sides adjacent to the first partial coolant jacket, extend, coming from the crankcase, to a large extent around the gas exchange outlet channel and merge with the first partial coolant jacket in the direction of the gas exchange intake side. In a further advantageous embodiment, the second and third partial coolant jackets extend, coming from the gas exchange outlet channel, on both the sides of the gas exchange valves, in the direction of the gas exchange intake side and on the intake side again in the direction of the crankcase. These embodiments improve once more the entire cooling of the cylinder head according to the invention, because the heat removal from the hot areas is homogenized.

According to a further preferred embodiment, an exhaust gas manifold is provided for the cylinder head on the gas exchange outlet side, wherein the second and third partial coolant jackets extend at least in sections into the exhaust gas manifold. With this embodiment, an exhaust gas manifold can also be temperature controlled in an advantageous way. This exhaust gas manifold can be either mounted on the cylinder head as a separate component or is integral with the cylinder head.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
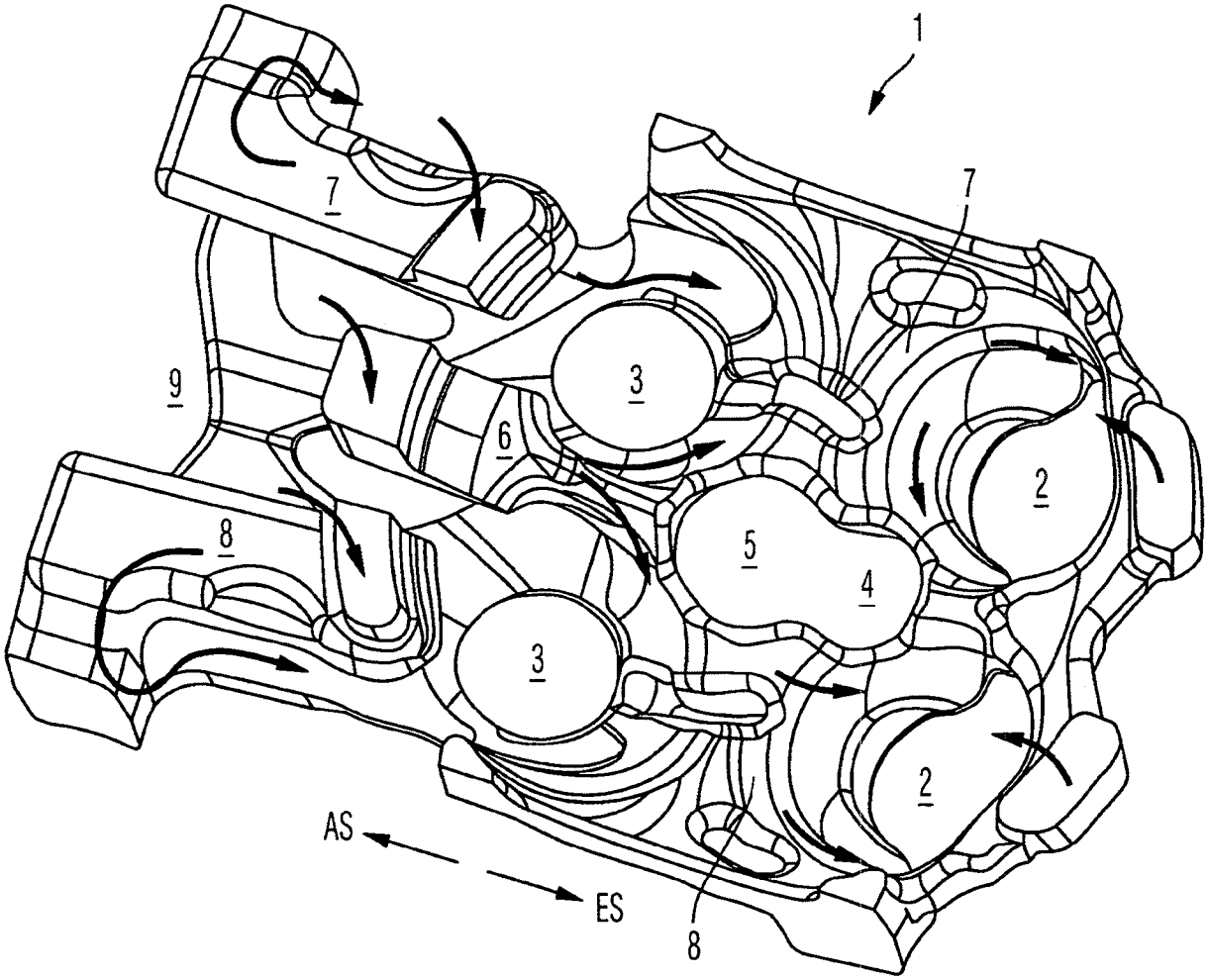
FIG. 1 is a three dimensional depiction of an exemplary inventive coolant jacket for a cylinder head that is cooled with liquid.

In the following, identical reference numerals are used for the same elements in both figures.

FIG. 1 is a three dimensional view of a coolant jacket 1 for a cylinder head that is cooled with liquid. This cylinder head, which is not shown in detail, is configured for an internal combustion engine with a crankcase. The coolant jacket 1 corresponds to a sand core that is used to cast a corresponding cylinder head that is cooled with liquid. The coolant jacket 1 is seen from the direction of the crankcase at an oblique angle relative to the underside of the cylinder head (in the installed state the side facing the crankcase). The cylinder head includes a gas exchange intake side (ES) with two gas exchange intake valves 2 and a gas exchange outlet (exhaust) side (AS) with two gas exchange outlet (exhaust) valves 3. Since the components, such as the gas exchange valves 2, 3 or other channels are not shown explicitly, they are marked as representative of the locations at which these components would be typically found.

Furthermore, the cylinder head includes a gas exchange outlet channel 9 on the outlet side. Between the gas exchange valves 2, 3 there is a fuel injection valve 4 on the intake side and an ignition device 5 on the outlet side. Furthermore, FIG. 1 shows a coolant jacket 1 for only a single cylinder of the internal combustion engine, but the coolant jacket 1 can be expanded for an arbitrary number of cylinders.

The coolant jacket 1 consists in essence of a first partial coolant jacket 6, which is arranged in a largely centered manner between the gas exchange outlet valves 3; a second partial coolant jacket 7 and a third partial coolant jacket 8 arranged adjacent to the first partial coolant jacket 6 on both sides. Each of these partial coolant jackets 6, 7, 8 has, coming from the crankcase on the outlet side, its own inflow point. The inflow of a coolant is depicted symbolically with three arrows. The essential flow directions of the coolant in the cylinder head are also depicted symbolically by use of arrows. According to an embodiment of the invention, the coolant jacket 1 is configured to extend as a first partial coolant jacket 6 on the outlet side, coming from the crankcase, between the gas exchange outlet valves 3 and then radially outside around the ignition device 5 and the fuel injection valve 4 and further in the direction of the gas exchange intake side (ES) and back into the crankcase. An overflow back into the crankcase at two outflow points is shown once again symbolically by means of two arrows.

The second and third partial coolant jackets 7, 8 extend on both sides adjacent to the first partial coolant channel 6, coming from the crankcase, to a large extent around the gas exchange outlet channel 9 and further in the direction of the gas exchange intake side (ES) and then extend into the first partial coolant channel 6. The second and the third partial coolant jackets 7, 8 extend further, coming from the gas exchange outlet channel 9, on both sides of the gas exchange valves 2, 3 in the direction of the gas exchange intake side (ES) and at the two outflow points again back into the crankcase.

In an additional, particularly preferred design variant, which is not depicted, an exhaust gas manifold is provided for the cylinder head on the gas exchange outlet side (AS). In this case the second and the third partial coolant jackets 7, 8 extend at least in sections into the exhaust gas manifold. In this embodiment, it is possible to control the temperature of the exhaust gas manifold in an advantageous way. In this case the exhaust gas manifold can be a separate component or can be constructed in one piece with the cylinder head.

Figure 2:
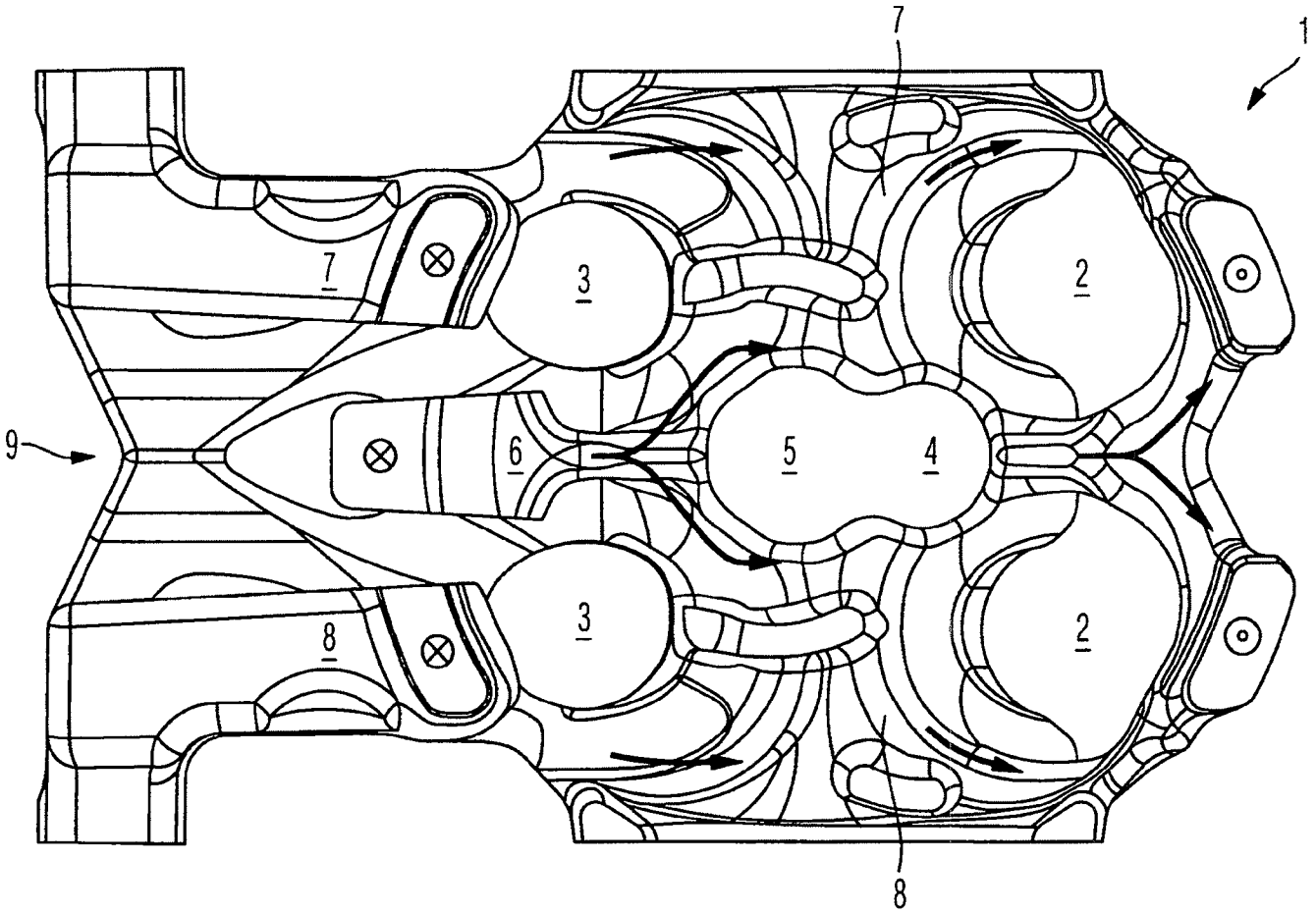
FIG. 2 is a bottom view of the exemplary inventive coolant jacket for a cylinder head cooled with liquid.

FIG. 2 is a bottom view of the coolant jacket 1 shown in FIG. 1. The view in FIG. 2 is directed perpendicular to a separating plane between the cylinder head and the crankcase. The aforesaid with respect to FIG. 1 also applies in this case, where the main directions of the coolant flow are shown once again by means of arrows. The inflow of the coolant into the cylinder head is depicted at the inflow points by use of the symbol ⊗ ; and the outflow of the coolant from the cylinder head is depicted at the outflow points by means of the symbol ⊙.

The coolant jacket 1 is designed in such a way that the coolant flows from the gas exchange outlet side (AS) from the crankcase, coming centrally relative to the cylinder into the cylinder head (optionally, also laterally next to the gas exchange outlet channels) and from there in close proximity to the combustion chamber roof between the gas exchange outlet valves 3 and around the ignition device 5 and the fuel injection valve 4 in the direction of the gas exchange intake side (ES). In particular, the first partial coolant jacket 6 envelops to a large extent the threaded region of the ignition device 5.

Optimal cooling of the cylinder head according to the invention enables high specific power outputs and high pressure levels, even in the case of high coolant temperatures and an economical cylinder head alloy that is less temperature resistant. This feature leads to a distinct advantage with respect to both the fuel consumption and the cost.

LIST OF REFERENCE NUMERALS AND CHARACTERS

1. coolant jacket
2. gas exchange intake valves
3. gas exchange outlet valves
4. fuel injection valve
5. ignition device
6. first partial coolant jacket
7. second partial coolant jacket
8. third partial coolant jacket
9. gas exchange outlet channel
AS gas exchange outlet side
ES gas exchange intake side The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A coolant jacket for a liquid-cooled cylinder head for an internal combustion engine having a crankcase, the cylinder head having a gas exchange intake side with two gas exchange intake valves and a gas exchange outlet side with two gas exchange outlet valves, a fuel injection valve on the intake side of the cylinder head and an ignition device on the outlet side of the cylinder head are arranged between the gas exchange intake and outlet valves, the coolant jacket comprising:

a first partial coolant jacket, wherein the first partial coolant jacket extends on the outlet side, coming from the crankcase, between the gas exchange outlet valves, the first partial coolant jacket then extending radially outside around a single cavity, the ignition device and the fuel injection valve being disposed in the single cavity, and the first partial coolant jacket then further extending in a direction of the intake side and the crankcase, wherein the cylinder head has a gas exchange outlet channel on the gas exchange outlet side, the coolant jacket further comprising:

a second partial coolant jacket; and a third partial coolant jacket, wherein the second and third partial coolant jackets are arranged on both sides adjacent to the first partial coolant jacket, and the second and third partial coolant jackets extend, coming from the crankcase, around the gas exchange outlet channel and then merge with the first partial coolant jacket in the direction of the intake side, and wherein the first, second, and third partial coolant jackets are positioned on a same plane, so as to be positioned at a same height within the cylinder head.

2. The coolant jacket according to claim 1, wherein along a flow direction of the first partial coolant jacket the gas exchange outlet valves are closer to the ignition device than to the fuel injection valve.

3. The coolant jacket according to claim 1, wherein: the second and third partial coolant jackets extend, coming from the gas exchange outlet channel, on both sides of the gas exchange valves in the direction of the intake side, and then extend on the intake side in a direction of the crankcase.

4. The coolant jacket according to claim 3, wherein: the second and third partial coolant jackets extend at least partially into an exhaust gas manifold provided for the cylinder head on the gas exchange outlet side.

5. The coolant jacket according to claim 1, wherein: the second and third partial coolant jackets extend at least partially into an exhaust gas manifold provided for the cylinder head on the gas exchange outlet side.

6. A coolant jacket for a liquid-cooled cylinder head for an internal combustion engine having a crankcase, the cylinder head having a gas exchange intake side with two gas exchange intake valves and a gas exchange outlet side with two gas exchange outlet valves, a fuel injection valve on the intake side of the cylinder head and an ignition device on the outlet side of the cylinder head are arranged between the gas exchange intake and outlet valves, the coolant jacket comprising:

a first partial coolant jacket, a second partial coolant jacket, and a third partial coolant jacket, wherein the first partial coolant jacket extends on the outlet side, coming from the crankcase, between the gas exchange outlet valves, the first partial coolant jacket then extending radially outside around a single cavity, the ignition device and the fuel injection valve being disposed in the single cavity, and the first partial coolant jacket then further extending toward the two gas exchange intake valves, in a direction of the intake side and then further extending down into the crankcase, and wherein the first, second, and third partial coolant jackets are positioned on a same plane, so as to be positioned at a same height within the cylinder head.

7. The coolant jacket according to claim 6, wherein along a flow direction of the first partial coolant jacket the gas exchange outlet valves are closer to the ignition device than to the fuel injection valve.

8. The coolant jacket according to claim 7, wherein the cylinder head has a gas exchange outlet channel on the gas exchange outlet side, the second and third partial coolant jackets are arranged on both sides adjacent to the first partial coolant jacket, and the second and third partial coolant jackets extend, coming from the crankcase, around the gas exchange outlet channel.

9. The coolant jacket according to claim 8, wherein coming into the liquid-cooled cylinder head from the crankcase, each of the first, second, and third partial coolant jackets has its own inflow location.

10. The coolant jacket according to claim 9, wherein the second and third partial coolant jackets respectively merge with the first partial coolant jacket at given regions of the first partial coolant jacket that are immediately adjacent to one of the gas exchange outlet valves and to the ignition device, thereby improving cooling at the given regions of the first partial coolant jacket.

11. The coolant jacket according to claim 10, wherein along a flow direction of the coolant, an inflow location of the first partial coolant jacket is downstream of: i) the outlet channel, ii) an inflow location of the second partial coolant jacket, and iii) an inflow location of the third partial coolant channel.

12. The coolant jacket according to claim 11, wherein the second and third partial coolant jackets extend, coming from the gas exchange outlet channel, on both sides of the gas exchange valves in the direction of the intake side, and then extend on the intake side in a direction of the crankcase.

13. The coolant jacket according to claim 12, wherein the second and third partial coolant jackets extend at least partially into an exhaust gas manifold provided for the cylinder head on the gas exchange outlet side.

14. The coolant jacket according to claim 11, wherein the second and third partial coolant jackets extend at least partially into an exhaust gas manifold provided for the cylinder head on the gas exchange outlet side.

15. The coolant jacket according to claim 11, wherein the first partial coolant jacket radially surrounds a single opening within which the ignition device and the fuel injection valve are disposed.

* * * * *